United States Patent [19]

Dauvergne

[11] Patent Number: 4,554,763

[45] Date of Patent: Nov. 26, 1985

[54] ELECTRIC GLASS-RAISING DEVICE FOR A MOTOR VEHICLE

[75] Inventor: Jean Dauvergne, Sully sur Loire, France

[73] Assignee: Compagnie Industrielle de Mechanismes, France

[21] Appl. No.: 561,428

[22] Filed: Dec. 14, 1983

[30] Foreign Application Priority Data

Dec. 14, 1982 [FR] France ..... 82 20946

[51] Int. Cl.[4] ..... E05F 15/08; E05F 11/44

[52] U.S. Cl. ..... 49/349; 49/351

[58] Field of Search ..... 49/349, 351

[56] References Cited

U.S. PATENT DOCUMENTS 2,829,885 4/1958 Russell ..... 49/349 X
3,069,152 12/1962 Arlavskas et al. ..... 49/349
3,357,133 12/1967 Helsing ..... 49/349 X
3,857,197 12/1974 Reddy et al. ..... 49/349 X
3,897,652 8/1975 Hess ..... 49/351

*Primary Examiner*—Philip C. Kannan

[57] ABSTRACT

The device comprises two arms 1, 2 arranged in an X-configuration inside the door 3 of the vehicle and supporting the window glass 4. One arm, 1, is a driving arm and the other arm, 2, a driven arm and the driving arm 1 is fixed adjacent one end to a support 5 capable of being driven in rotation by a motor-speed reducer unit 6 controlled by a button 7. The latter is connected to the driving arm 1 in such manner as to be kinematically related to the latter and is slidable in a slot 12 formed in the inner panel 13 of the door 3. In this way the driver can accompany the movement of the glass 4 by exerting a thrust on the button 7 in a travel of the order of a decimeter so that he is able to adjust the position of the glass 4 with precision.

8 Claims, 12 Drawing Figures

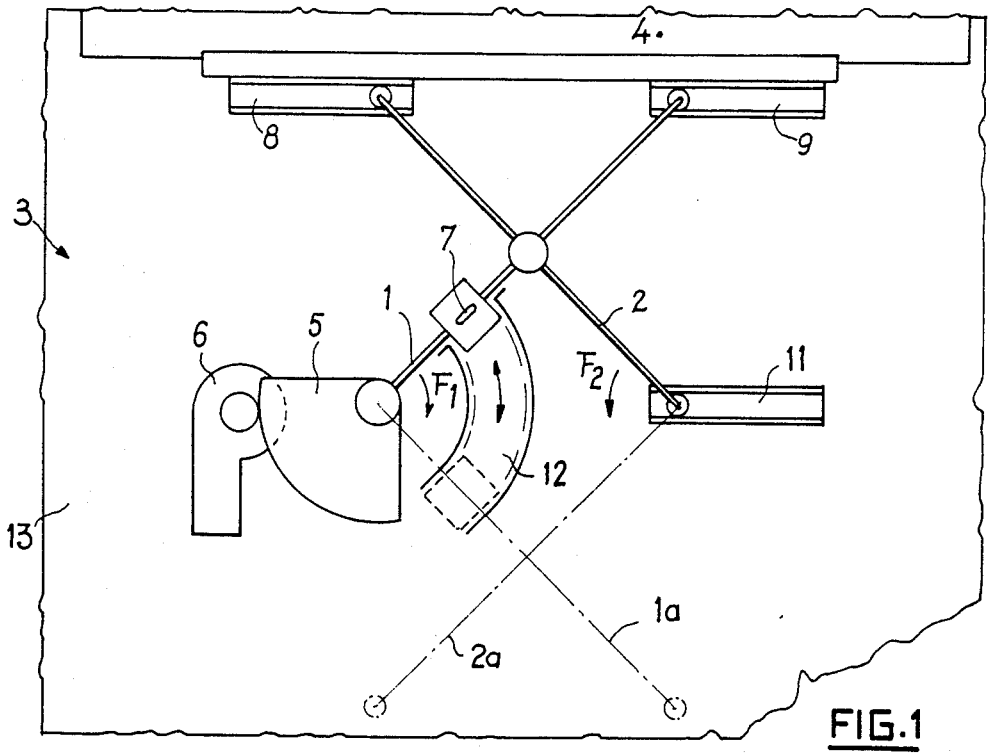
FIG.1
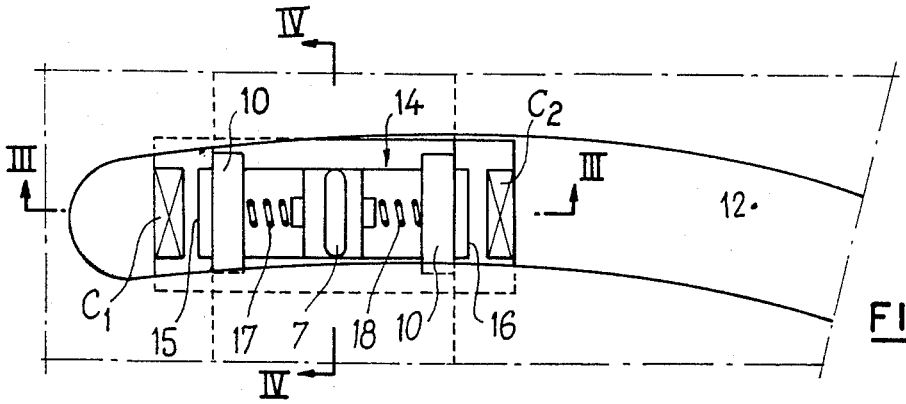
FIG.2
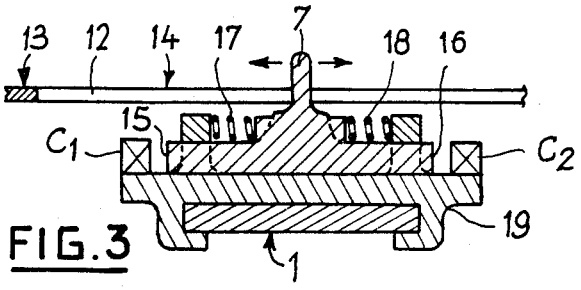
FIG.3
FIG.4
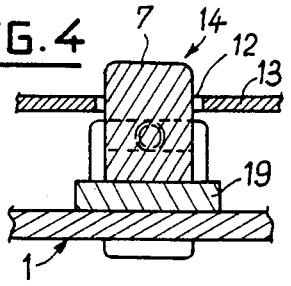

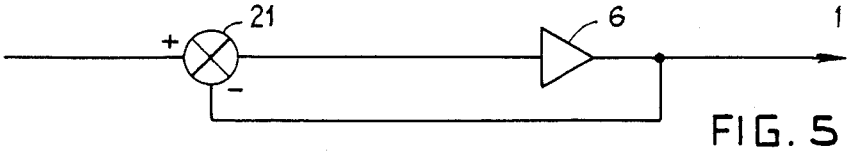
FIG. 5
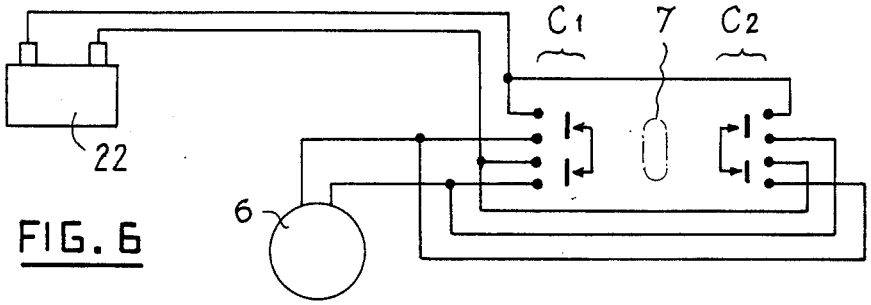
FIG. 6
FIG. 7
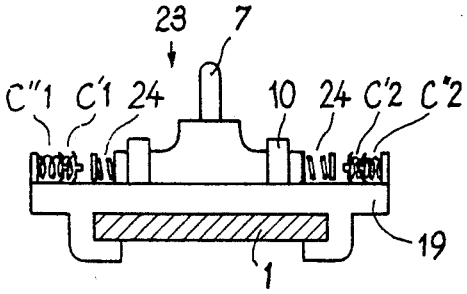
FIG. 9
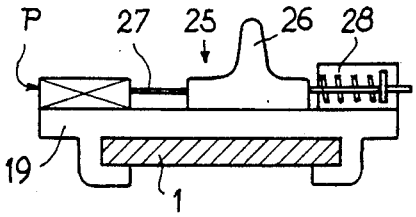
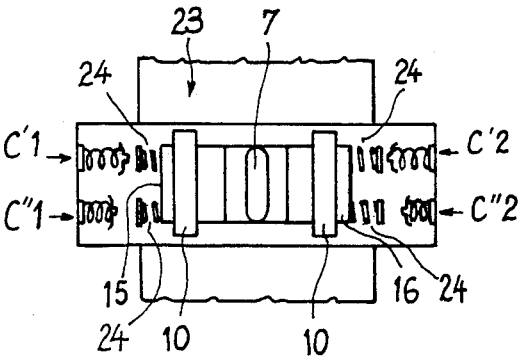
FIG. 8

ELECTRIC GLASS-RAISING DEVICE FOR A MOTOR VEHICLE

The present invention relates to an electric glass-raising device for a motor vehicle, of the type comprising two arms arranged in an X-configuration disposed inside the door of the vehicle and supporting the corresponding window glass.

In this type of glass raiser, one of the arms is a driving arm and the other a driven arm, the driving arm being pivotally mounted adjacent one of its ends on a support capable of being driven in rotation by a motor-speed reducer unit controlled by a manual control means, its other end being slidably mounted in a slideway connected to the glass. The second arm is pivotally mounted on the first-mentioned arm and slidably mounted, on one hand, in a slideway of the door and, on the other hand, in a second slideway connected to the glass.

The switch constituting the manual control means is usually disposed on the dashboard and its travel is of the order of a millimeter so that it acts is an "on-off" manner.

Consequently, it is not possible to adjust in a fine manner the position of the glass because the time which elapses between the fully opened position and the fully closed position of the glass is of the order of a few seconds.

An object of the invention is to permit a much more precise adjustment of the position of the glass by the driver of the vehicle.

According to the invention, the control means is connected to the driving arm so as to be kinematically related to the latter and this control means projects outside a slot provided in the inner trimming panel of the door and extending throughout the length of the travel of the control means arm between the end positions of the glass, the control means being slidable in this slot during the movement of the arms.

Under these conditions, the driver is able to control the position of the glass in a travel which is no longer of the order of a millimeter but of the order of a decimeter so that he can more easily "follow" the position of the glass.

According to one embodiment of the invention, the control means is a switch provided with two series of electric contacts corresponding to two shifting speeds of the arms, namely a rapid speed and a slow speed in each direction of operation.

Thus, by urging the switch to one side or the other, depending on whether the driver wishes to raise or lower the glass, the first contact establishes a high speed of lowering or raising, and the second a low speed of fine adjustment, the connection of the switch with the low speed contact being achieved by a stronger pressure exerted on the switch.

According to another embodiment, the control means controls an analog unit such as a potentiometer.

Usually, the control means is installed in such manner that its reference follows the output element mechanically without intervention of a position copying means, such as a potentiometer, encoder, etc.

This feature, in combination with the preceding feature, therefore permits a very precise adjustment of the position of the glass.

Further features and advantages of the invention will be apparent from the following description with reference to the accompanying drawings in which several embodiments of the glass-raising device according to the invention has been shown by way of non-limiting examples.

FIG. 1 is a diagrammatic elevational view, with a part cut away, of an electric glass-raising device according to the invention.

FIG. 2 is a partial elevational view, to an enlarged scale relative to FIG. 1, of the control means of the glass raiser.

FIG. 3 is a sectional view taken along line III—III of FIG. 2.

FIG. 4 is a cross-sectional view of the switch taken along the line IV—IV of FIG. 2.

FIG. 5 is an electric diagram of the control loop in which may be inserted the switch and the motor-speed reducer unit of the glass raiser shown in FIGS. 1 to 4.

FIG. 6 is a partial electric diagram illustrating the possibility of controlling the motor-speed reducer unit of the device shown in FIGS. 1 to 5 in the two directions of operation corresponding to the raising and lowering of the glass.

FIGS. 7 and 8 are respectively views similar to FIGS. 3 and 2 of a second embodiment of the invention.

FIG. 9 is a sectional view similar to FIG. 7 of a control means according to a third embodiment.

FIGS. 1 to 6 show a first embodiment of an electric glass-raising device for a motor vehicle according to the invention.

Figure 10:
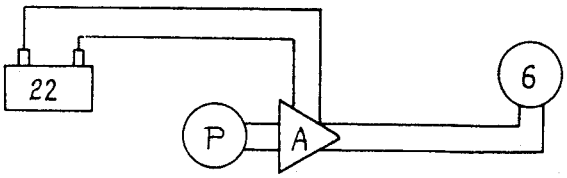
FIG. 10 is a simplified electric diagram corrresponding to the embodiment shown in FIG. 9.

This device comprises (FIG. 1) two arms 1, 2 arranged in an X-configuration and disposed inside the door 3 of the vehicle and supporting the corresponding window glass 4. In the known manner, the driving arm 1 is fixed adjacent one of its ends to a support 5 constituted by a toothed sector which is capable of being driven in rotation by a motor-speed reducer unit 6. The latter is controlled by a manual control means constituted by a control button 7 to which it is connected by electric connections shown in FIG. 6.

The other end of the arm 1 and the ends of the second arm 2 are slidably mounted in slideways 8, 9 connected to the glass and a slideway 11 connected to the door 3. Shown in full lines in FIG. 1 are the positions of the arms 1 and 2 when the glass 4 has been raised, and in dot-dash lines the respective positions 1*a* and 2*a* of the arms 1 and 2 when the glass 4 is in the lowered position after corresponding pivoting of the arms 1, 2 through about 90° as shown by the arrows F1 and F2.

According to the invention, the control button 7 is mounted on the driving arm 1 so as to be kinematically related to the latter. The button 7 projects through a curved slot 12 formed in the inner trimming panel 13 of the door 3. The slot 12 therefore extends along a circular sector corresponding to the entire length of the angular travel of the arm 1 and the button 7 carried by the latter, between the end positions of the glass 4 so that the control button 7 can in fact slide in the slot 12 during the movement of the arms 1, 2.

The button 7 is part (FIGS. 2 and 3) of a switch generally designated by the reference numeral 14 and provided with electric contacts $C_1$, $C_2$. The switch 14 also includes two studs 15, 16 disposed on each side of the button 7, two return springs 17, 18 being interposed between the button and two yokes 10 for axially guiding and retaining the button 7 on a base 19 rigid with the arm 1.

In this arrangement, when a thrust is exerted on the button 7 in the direction of the contact $C_1$ or $C_2$, the corresponding stud 15 or 16 establishes the electric contact and the motor-speed reducer unit 6 is actuated and pivots the sector 5 in the direction for raising or lowering the glass 4, depending on whether the contact has been established with the contacts $C_1$ or $C_2$.

It will be understood that the assembly constitutes a servocontrol diagrammatically represented in FIG. 5. It includes the button 7 and the motor-speed reducer 6. The feed-back or return loop is unitary since the button 7 moves with the arm 1 and the comparator 21 is within the switch 14.

In this servocontrol, the set or reference signal is the position of the control means 7 actuated by the driver and the output signal is the position of the arm 1. The comparator 21 constantly effects comparisons between the values of these two signals so as to determine an error signal resulting from the difference between the two values in question so as to control the angular position of the arm 1 by means of the effective position of the control button 7. Depending on the sign of the error signal, the comparator 21 commands the motor-speed reducer 6 to continue the movement of the glass 4 or, on the contrary, to cause the glass to return slightly rearwardly until the error signal becomes zero. At this moment, the real position of the arm 1, and therefore of the glass 4, corresponds to the effective position of button 7 controlling the motor-speed reducer unit 6. The latter constitutes a cheap return or feed-back loop with no other intermediate element.

The electric connections between the contacts $C_1$, $C_2$, the motor speed reducer unit 6 and the supply battery 22 of the vehicle have been diagrammatically depicted in FIG. 6.

The length of the slot 12 formed in the door 3 is preferably substantially greater than 1 decimeter so that the effective travel of the control button 7 is of the order of a decimeter between the two end positions of the glass 4. Consequently, there is an improved capability on the part of the user to control the adjustment of the position of the glass 4 with precision relative to a button placed on the dashboard and having a travel of the order of a millimeter and operating in an on-off manner. The driver can, as it were, "follow" the movement of the glass with the button 7 sliding in the slot 12 and achieve the desired position of the glass 4 with high precision.

In the modification shown in FIGS. 7 and 8, the switch 23 is provided with two series of electric contacts $C'_1$–$C'_2$, and $C''_1$–$C''_2$. Between each of these contacts and the corresponding stud 15, 16 is interposed a coil spring 24 for returning the control button 7 to a median position. The contacts $C'_1$ and $C'_2$ are closer to this median position of the button 7 than the contacts $C''_1$ and $C''_2$ and the four contacts are of the resiliently actuated type or of the type having a resiliently mounted base, as shown. In this way it is possible to actuate first $C'_1$ (or $C'_2$) and then $C''_1$ (or $C''_2$). Consequently, when the driver exerts a thrust on the button 7 in one direction or the other, the electric contact is first of all established with $C'_1$ or $C'_2$ and the glass 4 is correspondingly shifted at high speed. If the driver increases the thrust exerted on the button 7, either of the contacts $C''_1$ and $C''_2$ is then actuated and the glass 4 is shifted at a low speed in the chosen direction of movement, which permits an approach adjustment of its position.

It will be understood that this modification also includes the servocontrol shown in FIG. 5.

In the third embodiment of the glass raiser shown in FIGS. 9 and 10, the switch 25 includes a control button 26 coupled to a rod 27 provided at one end with a spring 28 for returning the button 26 to its median position and in contact at its other end with a potentiometer P, all these elements being placed on the base 19. The potentiometer P is connected to the motor-speed reducer 6 through a suitable electronic system A connected to the battery 22 (FIG. 10).

The potentiometer P therefore replaces the contacts of the foregoing embodiments so that, when it is actuated by the button 26, the error signal produced by the servocontrol shown in FIG. 5 is no longer a on-off signal but an analog signal representing the real difference between the input and the output of the control.

Figure 11:
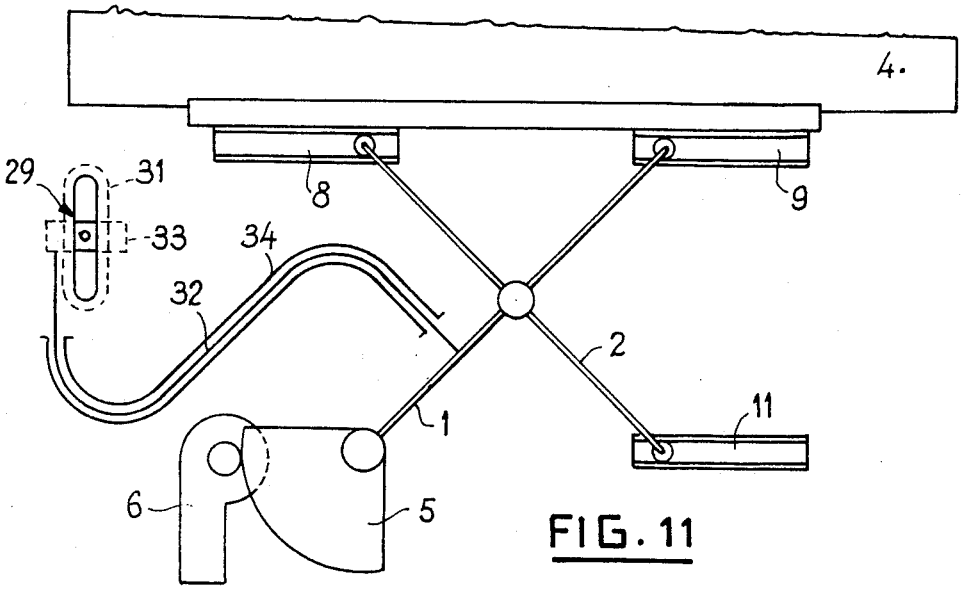
FIG. 11 is a simplified elevational view similar to FIG. 1 of a fourth embodiment of the glass raiser according to the invention.

The modification shown diagrammatically in FIG. 11 differs from the foregoing embodiments by the fact that the switch 29 is slidably mounted in a rectilinear slot 31 formed in the inner panel of the door 3 and preferably extending vertically. Further, the switch 29 is connected to the driving arm 1 by a flexible connecting means 32 which is arranged in the known manner to permit the remote control of the rotation of the arms 1 and 2 by shifting the control button 33, the connecting means 32 being disposed within a protective sheath 34.

This embodiment therefore permits the actuation of the glass raiser in an ergonomic manner by a vertical displacement of the button 33, with each position in the slot 31 corresponding to a position of the glass 4.

Figure 12:
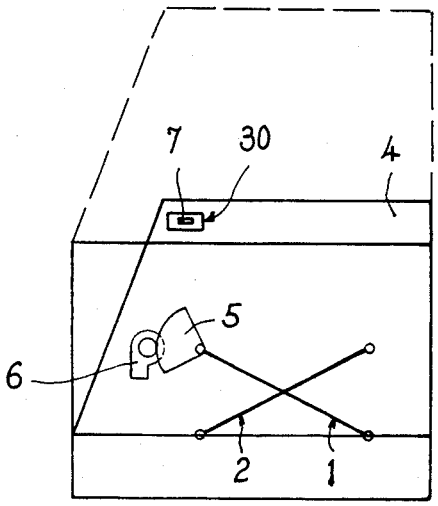
FIG. 12 is a diagrammatic view of a fifth embodiment of the device according to the invention.

It must be understood that the scope of the invention is not intended to be limited to the described embodiments and encompasses other modifications and in particular that in which the switch is fixed directly on the glass 4, in the upper part of the latter, as shown in FIG. 12. The electric connection can then be achieved by a printed circuit (not shown) on said glass 4.

What is claimed is:

1. An electric glass-raising device for a door of a vehicle, said device comprising two arms arranged in an X-configuration and disposed inside said door and supporting the glass, one of said arms being a driving arm and the other arm being a driven arm, a support fixed to said driving arm adjacent a first end of said driving arm and rotatably mounted relative to said door, a motor-speed reducer unit drivingly connected to said support for rotating said support, control means for actuating the unit, said driving arm having a second end opposed to said first end, a first slideway, a second slideway and a third slideway, the first and second slideways being connected to the glass and the third slideway being mounted on said door, said second end of said driving arm being slidably mounted in said first slideway, said driven arm having opposed ends respectively slidably mounted in said second slideway and said third slideway, said control means being connected to said driving arm in such manner as to be kinematically related thereto, an inner trimming panel on the door, means defining a slot in said panel, said control means projecting through said slot, said slot having a length allowing travel therein of said control means in movement of said glass between opposed end positions of said glass.

2. A device according to claim 1, wherein said unit is an electric unit and said device further comprises an electric circuit for connecting said unit to a source of electricity, said control means comprising a switch inserted in said circuit and having two series of electric contacts corresponding to two speeds of operation of said unit, including a rapid speed and a slow speed in two directions of operation for lowering and raising said glass.

3. A device according to claim 2, wherein the switch includes a comparator and the control means, the motor-speed reducer unit and the comparator collectively define a servo-control loop.

4. A device according to claim 3, wherein the control means further includes a potentiometer in electrical circuitry with the motor-speed reducer unit.

5. A device according to claim 1 wherein said unit is an electric unit and said device further comprises an electric circuit for connecting said unit to a source of electricity, said control means comprising a switch which is inserted in said circuit and movable in said slot, and a flexible connecting means connecting said switch to said driving arm and permitting remote control of said driving arm.

6. A device according to claim 5, wherein said slot is substantially vertical.

7. A device according to claim 5, wherein the switch includes a comparator and the control means, the motor-speed reducer unit and the comparator collectively define a servo-control loop.

8. A device according to claim 6, wherein the control means further includes a potentiometer in electrical circuitry with the motor-speed reducer unit.

* * * * *